US010878765B2

(12) United States Patent
Fujikawa et al.

(10) Patent No.: US 10,878,765 B2
(45) Date of Patent: Dec. 29, 2020

(54) ELECTRO-OPTIC DEVICE, METHOD OF DRIVING ELECTRO-OPTIC DEVICE, AND ELECTRONIC APPARATUS

(71) Applicant: SEIKO EPSON CORPORATION, Tokyo (JP)

(72) Inventors: Shinsuke Fujikawa, Chino (JP); Nariya Takahashi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/664,023

(22) Filed: Oct. 25, 2019

(65) Prior Publication Data

US 2020/0074954 A1 Mar. 5, 2020

Related U.S. Application Data

(62) Division of application No. 15/035,226, filed as application No. PCT/JP2014/005556 on Nov. 5, 2014, now abandoned.

(30) Foreign Application Priority Data

Nov. 8, 2013 (JP) ..... 2013-231913

(51) Int. Cl.
*G09G 3/36* (2006.01)

(52) U.S. Cl.
CPC ..... *G09G 3/3677* (2013.01); *G09G 3/3688* (2013.01); *G09G 2300/0408* (2013.01);
(Continued)

(58) Field of Classification Search
CPC ..... G09G 3/3677; G09G 3/3688; G09G 2310/0218; G09G 2300/0408;
(Continued)

(56) References Cited

U.S. PATENT DOCUMENTS 6,266,039 B1 7/2001 Aoki
2007/0080905 A1 4/2007 Takahara
(Continued)

FOREIGN PATENT DOCUMENTS

JP 2006-308712 A 9/2006
JP 2006-308712 A 11/2006
(Continued)

OTHER PUBLICATIONS

International Search Report in PCT application No. PCT/JP2014/005556 filed Nov. 5, 2014.
(Continued)

*Primary Examiner* — Mark W Regn
(74) *Attorney, Agent, or Firm* — JCIPRNET

(57) ABSTRACT

A plurality of signal lines are classified into k signal line groups (where k is an integer equal to or greater than 2). When the k signal line groups are supplied with an image signal during a horizontal scanning period, a driving unit supplies some of the k signal line groups with a precharge signal and subsequently an image signal, and does not supply the remainder of the k signal line groups with the precharge signal and supplies the remainder of the k signal line groups with the image signal.

12 Claims, 11 Drawing Sheets

(52) U.S. Cl.
CPC ..... *G09G 2310/0202* (2013.01); *G09G 2310/0218* (2013.01); *G09G 2310/0251* (2013.01); *G09G 2310/0297* (2013.01); *G09G 2320/0214* (2013.01); *G09G 2330/021* (2013.01)

(58) Field of Classification Search
CPC ... G09G 2310/0297; G09G 2310/0202; G09G 2310/0251; G09G 2320/0214; G09G 2330/021
See application file for complete search history.

(56) References Cited

U.S. PATENT DOCUMENTS

| | | | | |
|---|---|---|---|---|
| 2008/0180589 | A1 | 7/2008 | Woo et al. | |
| 2010/0045638 | A1 | 2/2010 | Cho et al. | |
| 2012/0056917 | A1 | 3/2012 | Ito | |
| 2013/0155038 | A1* | 6/2013 | Yamashita ..... | G09G 5/00 345/204 |

FOREIGN PATENT DOCUMENTS

| | | | |
|---|---|---|---|
| JP | 2007-199448 | A | 8/2007 |
| WO | 99/04384 | A1 | 1/1999 |

OTHER PUBLICATIONS

Written Opinion in PCT application No. PCT/JP2014/005556 filed Nov. 5, 2014.

* cited by examiner

[Fig. 7A]
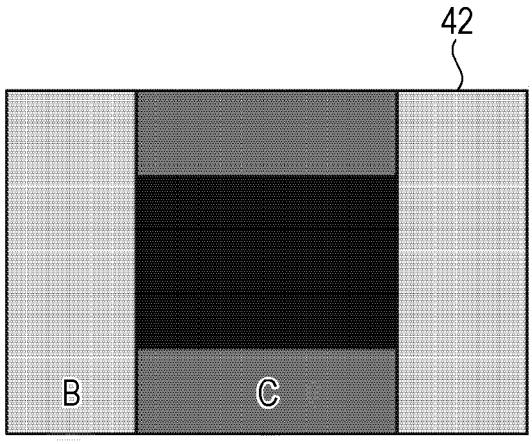
CROSSTALK AMOUNT [%]
= (BACKGROUND GRAYSCALE LUMINANCE B − CROSSTALK PORTION LUMINANCE C) / BACKGROUND GRAYSCALE LUMINANCE B × 100
[Fig. 7B]
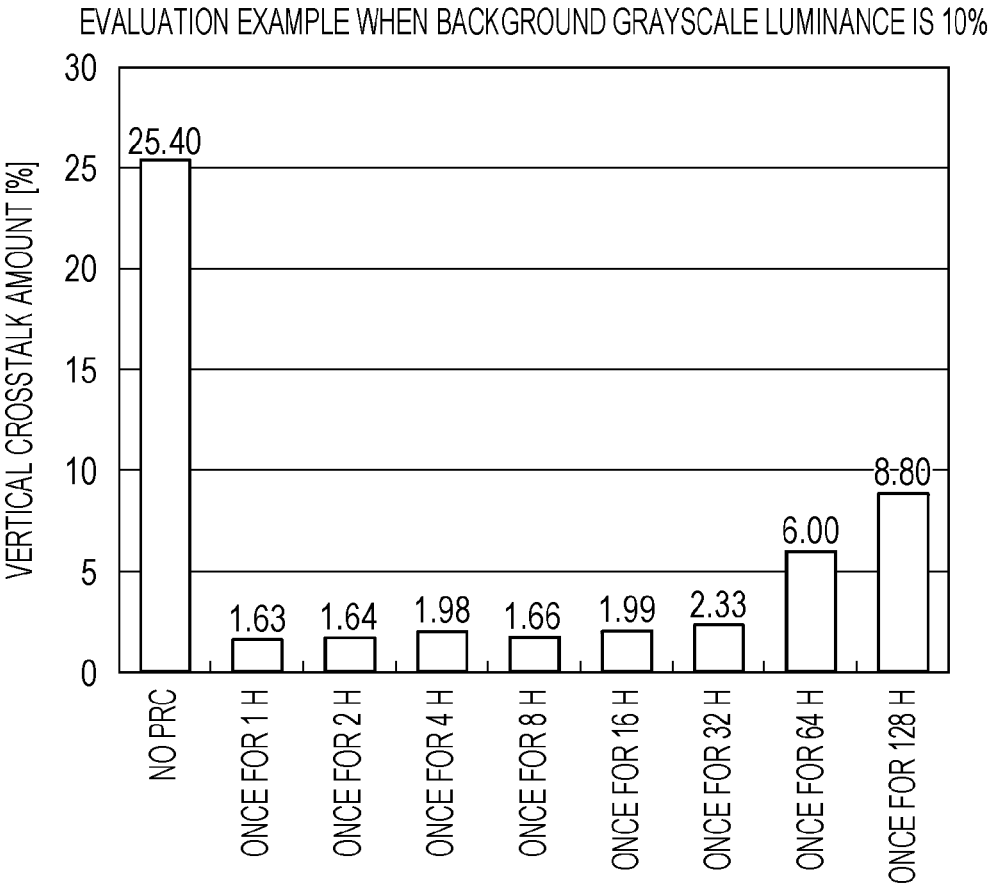

ELECTRO-OPTIC DEVICE, METHOD OF DRIVING ELECTRO-OPTIC DEVICE, AND ELECTRONIC APPARATUS

TECHNICAL FIELD

The present invention relates to an electro-optic device, a method of driving the electro-optic device, and an electronic apparatus.

BACKGROUND ART

In electronic apparatuses having a display function, transmissive electro-optic devices or reflective electro-optic devices are used. Light is radiated to such an electro-optic device, and transmitted light or reflected light modulated by the electro-optic device becomes a display image or is projected to a screen to become a projected image. Liquid crystal devices are known as electro-optic devices used in electronic apparatuses, and liquid crystal devices are devices that form images using dielectric anisotropy of liquid crystal and optical activity of light in liquid crystal layers.

In liquid crystal devices, scanning lines and signal lines are arranged in an image display region and pixels are disposed at intersections of the scanning lines and the signal lines in a matrix form. Pixel transistors are installed in the pixels and images are formed by supplying image signals to the pixels via the pixel transistors.

A method of obtaining a video with high display quality in an electro-optic device or an electronic apparatus using an electro-optic device is described in, for example, PTL 1. In PTL 1, in all of the signal lines, a precharge operation is performed once during one horizontal scanning period. The precharge operation is performed before an image signal is written to each pixel, and a voltage for the precharge operation is set in a timely manner according to a writing polarity. The precharge operation suppresses vertical crosstalk caused due to an optical leak current of a pixel transistor, and therefore a high-quality image is displayed. This method is especially considerably effective when a liquid crystal device is applied to a project or the like in which an incident light flux is large.

CITATION LIST

Patent Literature

PTL 1: International Publication No. 99/04384

SUMMARY OF INVENTION

Technical Problem

However, in the display method described in PTL 1, there is a problem that compatibility with high-definition image display may be difficult. As high definition progresses in a liquid crystal device, a horizontal scanning period is shortened. This is because when a precharge operation is inserted for each horizontal scanning period, an image signal writing period is shortened and a correct image signal may not be supplied to each pixel. Further, in the display method described in PTL 1, there is a problem that power consumption may increase and reliability of an electro-optic device may deteriorate. In the precharge operation, charge and discharge operations are different from those of the image signal. Therefore, the power consumption may necessarily increase. There was a concern that heat is generated in a driving semiconductor device due to an increase in power consumption and operation reliability of the driving semiconductor device or the electro-optic device may be damaged. In other words, in electro-optic devices of the related art, there is a problem that it is difficult to stably display a high-definition image in which crosstalk is suppressed with low power consumption.

Solution to Problem

The invention is devised to resolve at least some of the above-mentioned problems and can be realized in the following forms or application examples.

(Application Example 1) According to this application example, there is provided an electro-optic device including: a plurality of scanning lines; a plurality of signal lines; pixels disposed to correspond to intersections of the plurality of scanning lines and the plurality of signal lines; and a driving unit configured to supply a driving signal to the plurality of scanning lines and the plurality of signal lines. The plurality of signal lines are classified into k signal line groups (where k is an integer equal to or greater than 2). When the driving unit supplies an image signal to the k signal line groups during a horizontal scanning period, the driving unit supplies some of the k signal line groups with a precharge signal and subsequently the image signal, and does not supply the remainder of the k signal line groups with the precharge signal and supplies the remainder of the k signal line groups with the image signal during a horizontal scanning period. In this configuration, since crosstalk is suppressed and the number of precharge operations is reduced, the power consumption is also reduced. Accordingly, since the amount of generated heat is small, operation stability of the electro-optic device is also improved. That is, it is possible to realize the electro-optic device that stably displays a high-definition image in which crosstalk is suppressed with low power consumption.

(Application Example 2) In the electro-optic device according to Application Example 1, during a 1st horizontal scanning period, the driving unit may supply some of the k signal line groups with the precharge signal and subsequently the image signal, and may not supply the remainder of the k signal line groups with the precharge signal and may supply the remainder of the k signal line groups with the image signal. During a 2nd horizontal scanning period continuing from the 1st horizontal scanning period, the driving unit may supply some of the k signal line groups with the precharge signal and subsequently the image signal, and may not supply the remainder of the k signal line groups with the precharge signal and may supply the remainder of the k signal line groups with the image signal. The signal lines supplied with the precharge signal may differ between the 1st and 2nd horizontal scanning periods. In this configuration, since the signal lines supplied with the precharge signal differ between the 1st and 2nd horizontal scanning periods, the number of precharge operations is reduced, and the signal lines supplied with the precharge signal during the 1st horizontal scanning period and the signal lines supplied with the precharge signal during the 2nd horizontal scanning period can be changed.

(Application Example 3) In the electro-optic device according to Application Example 1 or 2, a vertical scanning period may include at least 1st to k-th horizontal scanning periods. During each of the 1st to k-th horizontal scanning periods, the driving unit may supply some of the k signal line groups with the precharge signal and subsequently the image signal, and may not supply the remainder of the k signal line groups with the precharge signal and may supply the remainder of the k signal line groups with the image signal. During the 1st to k-th horizontal scanning periods, the driving unit may supply the precharge signal to all of the k signal line groups. In this configuration, the number of precharge operations can be reduced and the precharge signal can be supplied to all of the signal lines.

(Application Example 4) In the electro-optic device according to Application Example 3, the vertical scanning period may include a horizontal scanning period in which all of the k signal line groups are not supplied with the precharge signal and are supplied with the image signal. In this configuration, since the vertical scanning period includes the horizontal scanning period in which the precharge signal is not supplied, the number of precharge operations can be further reduced.

(Application Example 5) In the electro-optic device according to Application Example 3 or 4, the driving unit may supply each of the k signal line groups with the precharge signal a plurality of times during the vertical scanning period. A period in which a given signal line group is supplied with the precharge signal and is subsequently supplied with a subsequent precharge signal may be equal to or less than 32 horizontal scanning periods.

In this configuration, crosstalk can be suppressed.

(Application Example 6) In the electro-optic device according to any one of Application Examples 1 to 5, the driving unit may supply the precharge signal and continuously supply the image signal. In this configuration, since the precharge signal and the image signal are continuously supplied, the number of times charging and discharging are performed with the operation of selecting the signal line groups, and thus the power consumption can be further reduced.

(Application Example 7) In the electro-optic device according to any one of Application Examples 1 to 6, the driving unit may control a supply period of the precharge signal and a supply period of the image signal. When the supply period of the precharge signal is shortened, the supply period of the image signal may be lengthened.

In this configuration, since the supply period of the image signal is lengthened, the exact image signal can be supplied to each pixel.

(Application Example 8) According to this application example, there is provided an electronic apparatus including the electro-optic device according to any one of Application Examples 1 to 7.

In this configuration, it is possible to realize the electronic apparatus including the electro-optic device that stably displays a high-definition image in which crosstalk is suppressed with low power consumption.

(Application Example 9) According to this application example, there is provided a method of driving an electro-optic device that includes a plurality of scanning lines, a plurality of signal lines, and pixels disposed to correspond to intersections of the plurality of scanning lines and the plurality of signal lines. The plurality of signal lines are classified into k signal line groups (where k is an integer equal to or greater than 2). A vertical scanning period includes at least a 1st horizontal scanning period. During the 1st horizontal scanning period, some of the k signal line groups are supplied with a precharge signal and subsequently, each of the k signal line groups is supplied with an image signal. In this method, since crosstalk is suppressed and the number of precharge operations is reduced, the power consumption is also reduced. Accordingly, since the amount of generated heat is small, operation stability of the electro-optic device is also improved. That is, it is possible to realize the electro-optic device that stably displays a high-definition image in which crosstalk is suppressed with low power consumption.

(Application Example 10) In the method of driving the electro-optic device according to Application Example 9, the vertical scanning period may further include a 2nd horizontal scanning period. During the 2nd horizontal scanning period, some of the k signal line groups may be supplied with the precharge signal, and subsequently each of the k signal line groups may be supplied with the image signal. The signal lines supplied with the precharge signal may differ between the 1st and 2nd horizontal scanning periods.

In this method, since the signal lines supplied with the precharge signal differ between the 1st and 2nd horizontal scanning periods, the number of precharge operations is reduced, and the signal lines supplied with the precharge signal during the 1st horizontal scanning period and the signal lines supplied with the precharge signal during the 2nd horizontal scanning period can be changed.

(Application Example 11) According to this application example, there is provided a method of driving an electro-optic device that includes a plurality of scanning lines, a plurality of signal lines, and pixels disposed to correspond to intersections of the plurality of scanning lines and the plurality of signal lines. The plurality of signal lines are classified into k signal line groups (where k is an integer equal to or greater than 2). A vertical scanning period includes at least k horizontal scanning periods of a 1st horizontal scanning period to a k-th horizontal scanning period. During each of the k horizontal scanning periods, some of the k signal line groups are supplied with a precharge signal, and subsequently each of the k signal line groups is supplied with an image signal. During the 1st to k-th horizontal scanning periods, all of the k signal line groups are supplied with the precharge signal the same number of times. In this method, the number of precharge operations can be reduced and the precharge signal can be supplied to all of the signal lines.

(Application Example 12) According to this application example, there is provided an electro-optic device driven by the method of driving the electro-optic device according to any one of Application Examples 9 to 11. In this configuration, it is possible to realize the electro-optic device that stably displays a high-definition image in which crosstalk is suppressed with low power consumption.

(Application Example 13) According to Application Example 13, there is provided an electronic apparatus including the electro-optic device according to Application Example 12. In this configuration, it is possible to realize the electronic apparatus including the electro-optic device that stably displays a high-definition image in which crosstalk is suppressed with low power consumption.

BRIEF DESCRIPTION OF DRAWINGS

FIG. 7A is a diagram for describing a relation between a frequency of a precharge operation and crosstalk.

FIG. 7B is a diagram for describing a relation between a frequency of a precharge operation and crosstalk.

DESCRIPTION OF EMBODIMENTS

Hereinafter, embodiments of the invention will be described with reference to the drawings. In the following drawings, scales of respective layers or members differ from the actual scales so that the respective layers and members have recognizable sizes.

Figure 1:
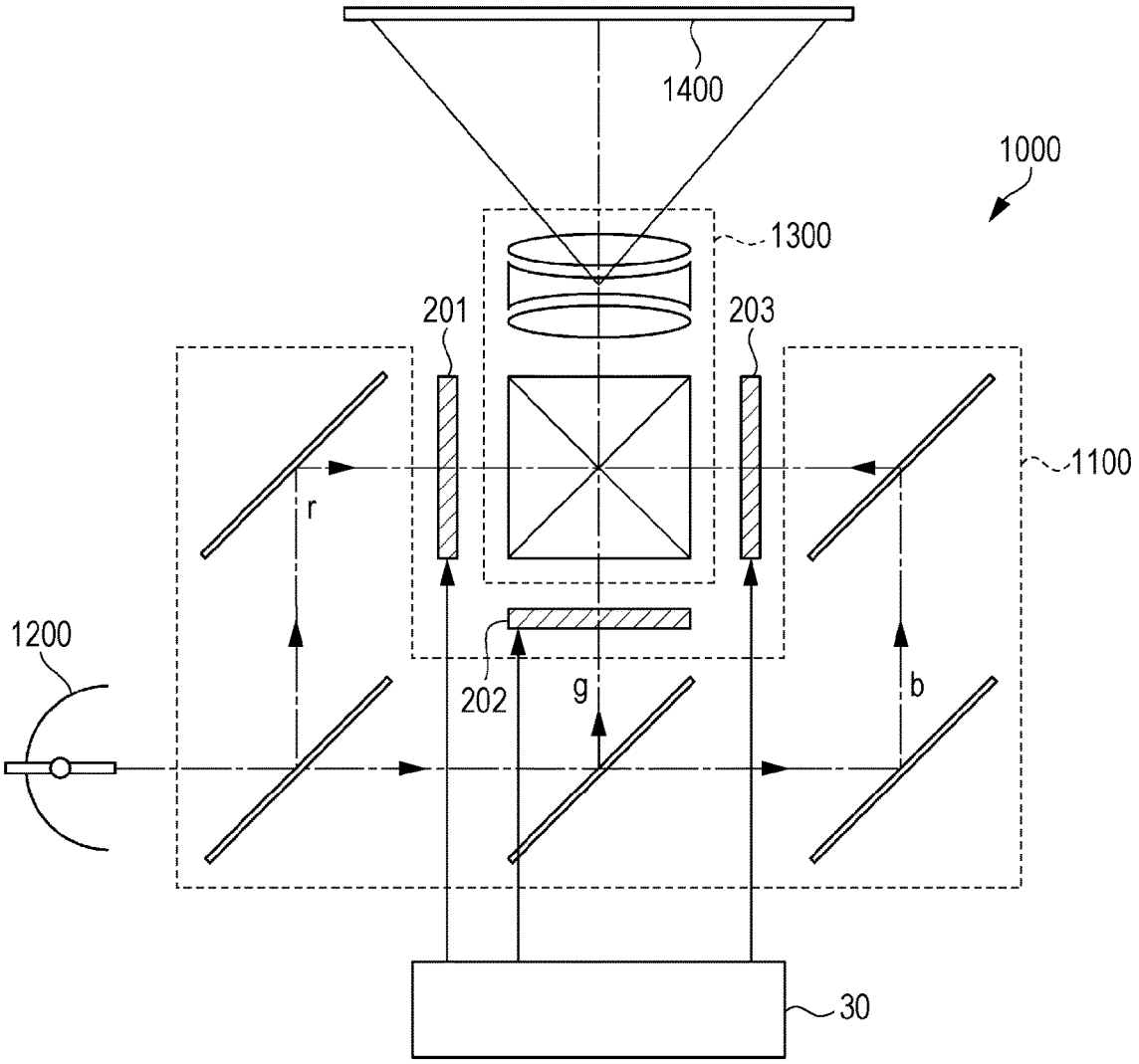
FIG. 1 is a schematic diagram illustrating a transmissive display apparatus which is an electronic apparatus.

First Embodiment (Overview of Electronic Apparatus) FIG. 1 is a schematic diagram illustrating a transmissive display apparatus (three-plate type projector) which is an example of an electronic apparatus. Hereinafter, the configuration of the electronic apparatus will be described with reference to FIG. 1.

The electronic apparatus (transmissive display apparatus 1000) includes at least three electro-optic devices 20 (see FIG. 2, hereinafter abbreviated as a first panel 201, a second panel 202, and a third panel 203) and a control device 30 that supplies control signals to the electro-optic devices 20. The first panel 201, the second panel 202, and the third panel 203 are the three electro-optic devices 20 corresponding to display colors (red, green, and blue) which become images. Hereinafter, when it is not necessary to particularly distinguish the first panel 201, the second panel 202, and the third panel 203 from each other, the first panel 201, the second panel 202, and the third panel 203 are simply referred to as the electro-optic devices 20 collectively.

An illumination optical system 1100 supplies a red component r of light exiting from an illumination device (light source) 1200 to the first panel 201, supplies green component g to the second panel 202, and supplies a blue component b to the third panel 203. Each of the electro-optic devices 20 functions as a light modulator (light valve) modulating each color light supplied from the illumination optical system 1100 according to a display image. A projection optical system 1300 combines the light exiting from the electro-optic devices 20 and projects the combined light to a projection surface 1400.

Figure 2:
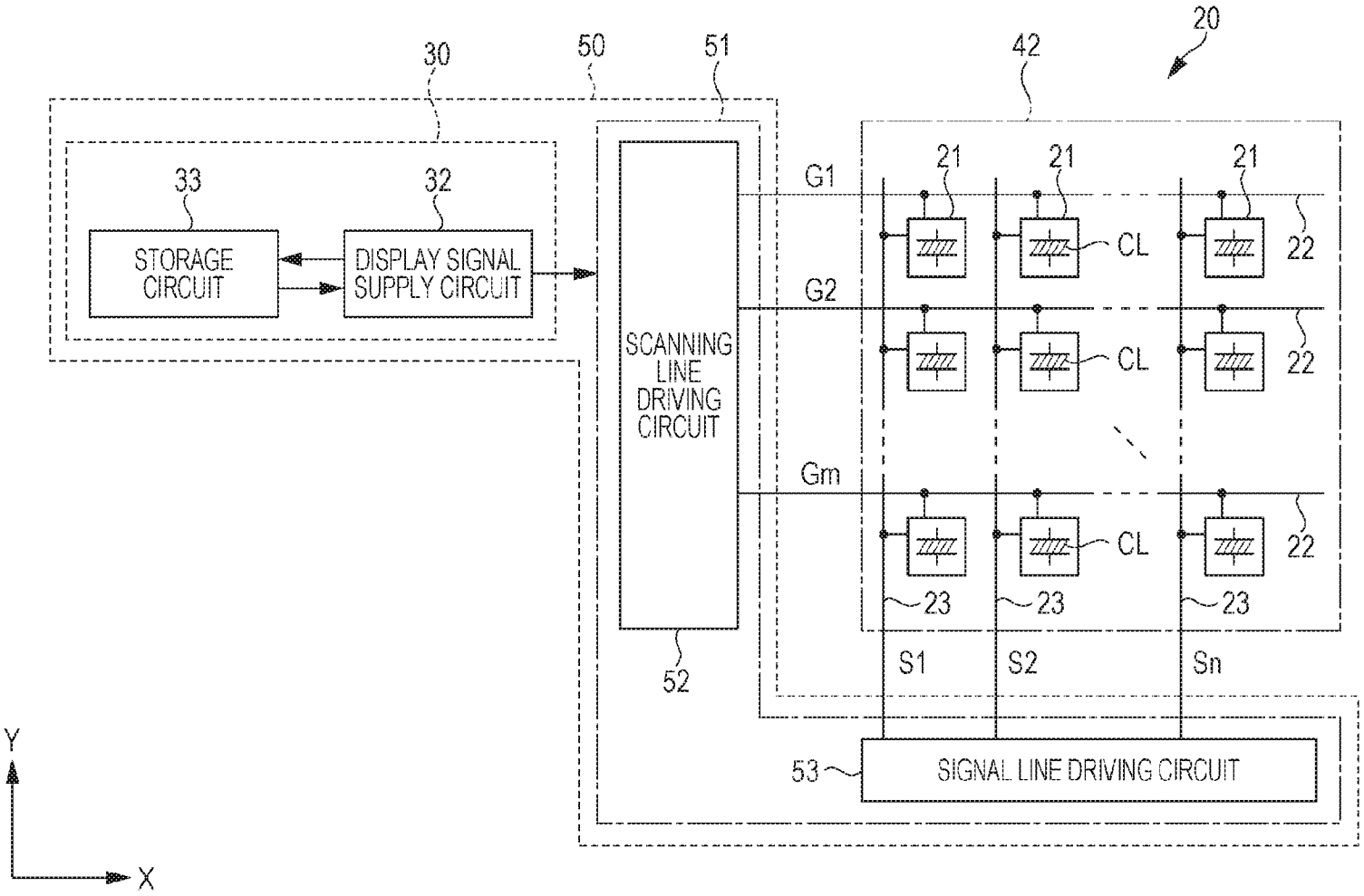
FIG. 2 is a circuit block diagram illustrating an electro-optic device.

(Circuit Configuration of Electronic Apparatus) FIG. 2 is a circuit block diagram illustrating the electro-optic device. Next, the circuit block configuration of the electro-optic device 20 will be described with reference to FIG. 2.

As illustrated in FIG. 2, the electro-optic device 20 includes at least a display region 42 and a driving unit 50. In the display region 42, a plurality of scanning lines 22 and a plurality of signal lines 23 intersecting each other are formed and pixels 21 are arranged in a matrix form to correspond to intersections of the scanning lines 22 and the signal lines 23. The scanning lines 22 extend in the row direction and the signal lines 23 extend in the column direction. When an i-th scanning line 22 is specified among the scanning lines 22, the i-th scanning line 22 is notated as a scanning line Gi. When a (jk+p)-th signal line 23 is specified among the signal lines 23, the (jk+p)-th signal line 23 is notated as a signal line Sjk+p (where j, k, and p will be described below in detail). In the display region 42, m scanning lines 22 and n signal lines 23 are formed (where m is an integer equal to or greater than 2 and n is an integer equal to or greater than 2). In the embodiment, the electro-optic device 20 and a method of driving the electro-optic device 20 will be described, for example, assuming that m=2168 and n=4112. In this case, a so-called 4K image of 2160 rows×4096 columns is displayed in the display region 42 of 2168 rows×4112 columns.

Various signals are supplied from the driving unit 50 to the display region 42, so that an image is displayed in the display region 42. That is, the driving unit 50 supplies driving signals to the plurality of scanning lines 22 and the plurality of signal lines 23. Specifically, the driving unit 50 is configured to include a driving circuit 51 that drives each pixel 21, a display signal supply circuit 32 that supplies display signals to the driving circuit 51, and a storage circuit 33 that temporarily stores a frame image. The display signal supply circuit 32 produces display signals (an image signal, a clock signal, and the like) from the frame image stored in the storage circuit 33 and supplies the display signals to the driving circuit 51. The display signal supply circuit 32 also produces a precharge signal PRC and supplies the precharge signal PRC to the driving circuit 51.

The driving circuit 51 is configured to include a scanning line driving circuit 52 and a signal line driving circuit 53. The scanning line driving circuit 52 outputs a scanning signal selecting or not selecting the pixels in the row direction to each scanning line 22 and the scanning line 22 delivers the scanning signal to the pixels 21. In other words, the scanning signal has a selection state and a non-selection state, and thus the scanning line 22 receives the scanning signal from the scanning line driving circuit 52 to be properly selected. The scanning line driving circuit 52 includes a shift register circuit (not shown) so that a signal shifting the shift register circuit is output as a shift output signal at each stage. The scanning signal is formed using the shift output signal. The signal line driving circuit 53 can supply the precharge signal PRC (see FIG. 5) or an image signal to each of the n signal lines 23 in synchronization with the selection of the scanning lines 22.

One display image is formed during one frame period. Each scanning line 22 is selected at least once during one frame period. In general, each scanning line 22 is selected once. Since a period in which one scanning line is selected is referred to as a horizontal scanning period, one frame period includes at least m horizontal scanning periods. Since one frame period is configured such that the scanning lines 22 are selected sequentially from the 1st scanning line G1 to the m-th scanning line Gm (or sequentially from the m-th scanning line Gm to the 1st scanning line G1), the frame period is also referred to as a vertical scanning period.

In the embodiment, the electro-optic device 20 is formed using a glass substrate (not shown) and the driving circuit 51 is formed using thin film elements such as thin film transistors in the glass substrate. The control device 30 includes the display signal supply circuit 32 and the storage circuit 33, and thus the control device 30 is configured as a semiconductor integrated circuit formed in a single crystal semiconductor substrate. In addition to this configuration, the display region 42 may be formed in a glass substrate and the driving circuit 51 may be formed as an integrated circuit formed in a single crystal semiconductor substrate, or both of the display region 42 and the driving circuit 51 may be configured to be formed in a single crystal semiconductor substrate.

Figure 3:
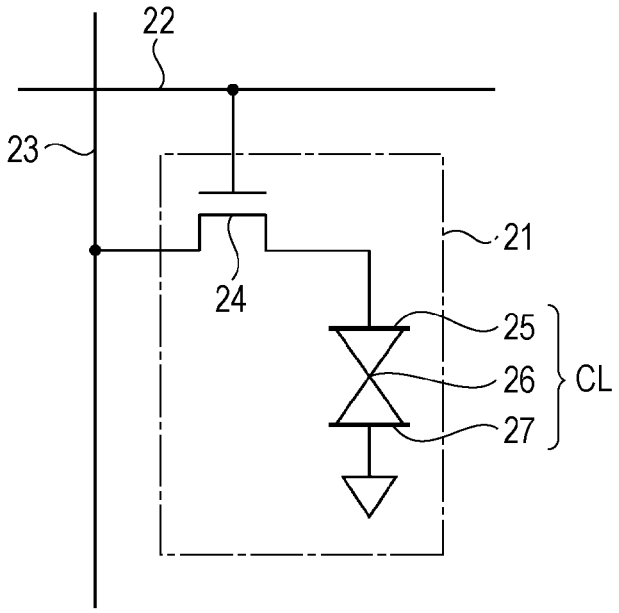
FIG. 3 is a circuit diagram illustrating a pixel.

(Configuration of Pixel) FIG. 3 is a circuit diagram illustrating each pixel. Next, the configuration of the pixel 21 will be described with reference to FIG. 3.

The electro-optic device 20 according to the embodiment is a liquid crystal device and an electro-optic material is liquid crystal 26. As illustrated in FIG. 3, each pixel 21 is configured to include a liquid crystal element CL and a pixel transistor 24. The liquid crystal element CL is an electro-optic element that includes a pixel electrode 25 and a common electrode 27 facing each other and the liquid crystal 26 of the electro-optic material is disposed between both of the electrodes. Transmittance of light passing through the liquid crystal 26 varies according to an electric field applied between the pixel electrode 25 and the common electrode 27. An electrophoresis material may be used as the electro-optic material instead of the liquid crystal 26. In this case, the electro-optic device 20 serves as an electrophoresis device and is used for an electronic book or the like.

The pixel transistor 24 is configured as an N-type thin film transistor of which a gate is connected to the scanning line 22 and is interposed between the liquid crystal element CL and the signal line 23 to control electric connection (conduction/non-conduction) of the liquid crystal element CL and the signal line 23. Accordingly, the pixel 21 (liquid crystal element CL) performs display according to a potential (image signal) supplied to the signal line 23 when the pixel transistor 24 is turned on. An auxiliary capacitor or the like connected in parallel to the liquid crystal element CL is not illustrated.

Figure 4:
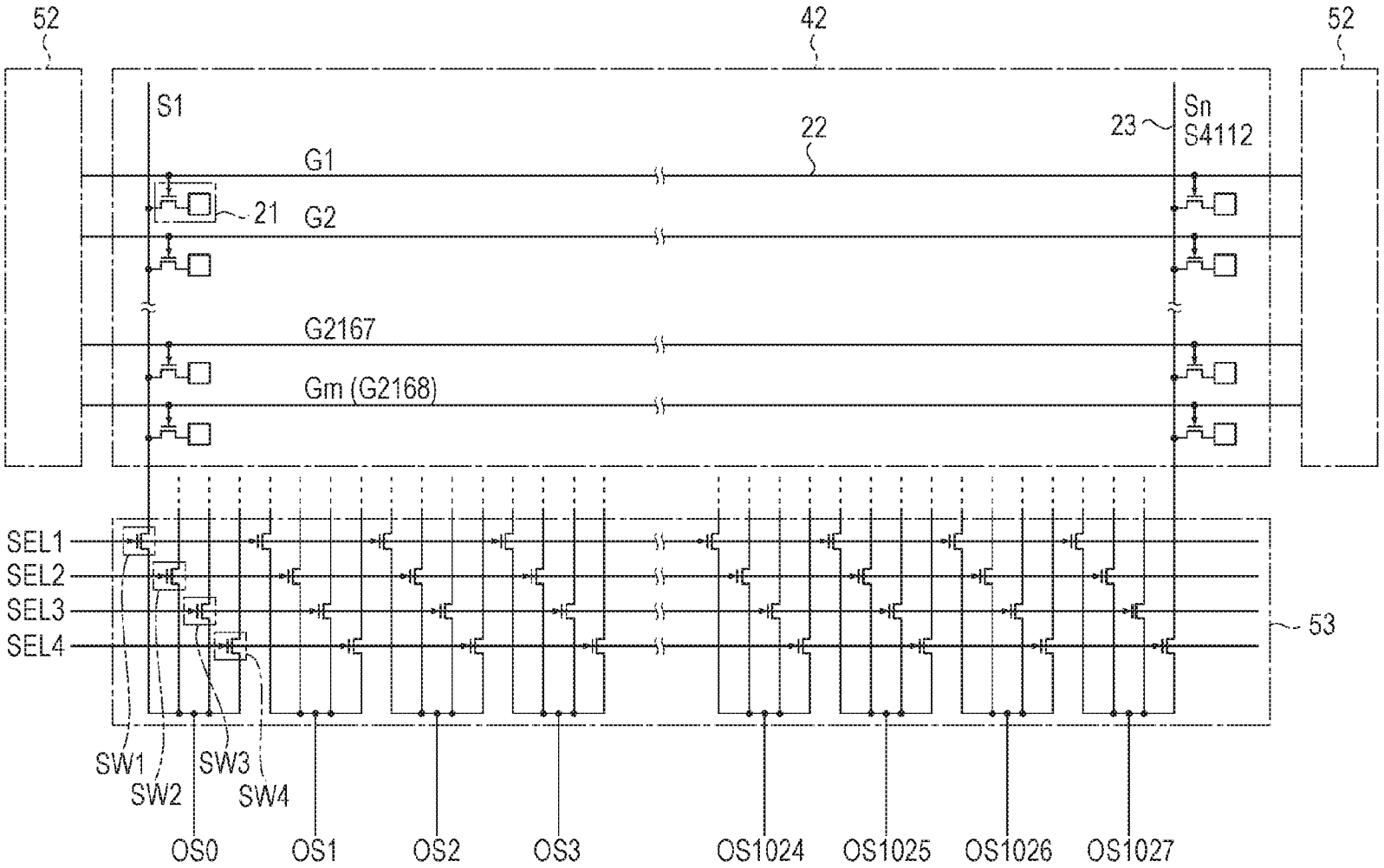
FIG. 4 is a diagram for describing the circuit configuration of a signal line driving circuit according to a first embodiment.

(Signal Line Driving Circuit 53) FIG. 4 is a diagram for describing the circuit configuration of the signal line driving circuit according to the first embodiment. Next, the configuration of the signal line driving circuit 53 will be described with reference to FIG. 4.

The signal line driving circuit 53 can supply the precharge signal PRC and the image signal to each of the n signal lines 23. First, the n signal lines 23 are classified into k signal line groups (where k is an integer equal to or greater than 2). That is, there are k kinds of sequence signals, and thus the n signal lines 23 are classified into k kinds of signal groups from a 1st sequence signal line (referred to as a 1st sequence signal line group) to a k-th sequence signal line (referred to as a k-th sequence signal line group) according to the k kinds of sequence signals. In a (jk+p)-th signal line Sjk+p, p is one value from 1 to k. The (jk+p)-th signal line Sjk+p belongs to a p-th sequence signal line group. A parameter j can take one integer value from 0 to q. The numerical value q is the maximum value of the parameter j and (q=n/k−1) which is a value obtained by subtracting 1 from a value obtained by dividing the number n of the signal lines 23 by the number of sequences k. In the embodiment, for example, since "n=4112" and "k=4" are set, the maximum value q which the parameter j can take is 1027 (q=1027). Accordingly, the 1st sequence signal line group is a collective of (jk+1)-th signal lines Sjk+1. Specifically, the 1st sequence signal line group includes 1028 signal lines 23, i.e., a 1st signal line S1 of "j=0," a 5th signal line S5 of "j=1," a 9th signal line S9 of "j=2," . . . , and a 4109th signal line S4109 of "j=1027." Likewise, the 2nd sequence signal line group is a collective of (jk+2)-th signal lines Sjk+2. Specifically, the 2nd sequence signal line group includes 1028 signal lines 23, i.e., a 2nd signal line S2 of "j=0," a 6th signal line S6 of "j=1," a 10th signal line S10 of "j=2," . . . , and a 4110th signal line S4110 of "j=1027." In this way, likewise, the k-th sequence signal line group is a collective of (jk+k)-th signal lines Sjk+k. Specifically, the k-th sequence signal line group includes 1028 signal lines 23, i.e., a k-th signal line Sk of "j=0," a 2k-th signal line S2*k* of "j=1," a 3k-th signal line S3*k* of "j=2," . . . , and a (q+1)k-th signal line S(q+1)k of "j=q" (in this example, a 4112th signal line S4112 of "j=1028").

In the signal line driving circuit 53, k sequence lines corresponding to the k kinds of sequence signals and (q+1) original signal lines are wired. A p-th sequence signal SELp is supplied to a p-th sequence line (where p is any integer from 1 to k). For example, a 1st sequence signal SEL1 is supplied to the 1st sequence line and a 2nd sequence signal SEL2 is supplied to a 2nd sequence line. Likewise, a k-th sequence signal SELk is supplied to a k-th sequence line. A j-th original signal OSj is supplied to a j-th original signal line. For example, a 0th original signal OS0 is supplied to a 0th original line, and a 1st original signal OS1 is supplied to a 1st original signal line. In this way, likewise, a q-th original signal OSq is supplied to a q-th original signal line.

The signal line driving circuit 53 includes 1st q+1 (that is, n/k) switches SW1 to k-th q+1 (that is, n/k) switches SWk. The 1st switches SW1 to the k-th switches SWk are formed as thin film transistors as in the pixel transistors 24. One end (one of the source and the drain) of a p-th switch SWp is electrically connected to the (jk+p)-th signal line Sjk+p, the other end (the other of the source and the drain) of the p-th switch SWp is electrically connected to a j-th original signal line, and the gate of the p-th switch SWp is electrically connected to a p-th sequence line. Accordingly, when the p-th sequence signal SELp becomes a selection signal, the p-th switch SWp is turned on and a j-th original signal OSj is supplied as the precharge signal PRC or the image signal to the (jk+p)-th signal line Sjk+p. For example, the 1st switch SW1 is disposed between the 0th original signal line and the 1st signal line S1 belonging to the 1st sequence signal line group, and the gate of the 1st switch SW1 is electrically connected to the 1st sequence line. Therefore, when the 1st sequence signal SEL1 becomes a selection signal, the 1st switch SW1 is turned on and the 0th original signal OS0 is supplied as the precharge signal PRC or the image signal to the 1st signal line S1. Likewise, for example, the 4th switch SW4 is disposed between the 1027th original signal line and the 4112th signal line S4112 belonging to the 4th sequence signal line group, and the gate of the 4th switch SW4 is electrically connected to the 4th sequence line. Therefore, when the 4th sequence signal SEL4 becomes a selection signal, the 4th switch SW4 is turned on and the 1027th original signal OS1027 is supplied as the precharge signal PRC or the image signal to the 4112th signal line S4112.

In the present specification, the fact that terminals 1 and 2 are electrically connected means that the terminals 1 and 2 have the same logic state (potential in terms of a design concept). Specifically, the fact includes not only a case in which the terminals 1 and 2 are directly connected by a wiring but also a case in which the terminals 1 and 2 are connected via a resistant element, a switching element, or the like. That is, when the same logic on a circuit is allowed in spite of the fact that a potential in the terminal 1 is slightly different from a potential in the terminal 2, the terminals 1 and 2 are considered to be electrically connected. Accordingly, for example, even when the 1st switch SW1 is disposed between the 1st signal line S1 and the 0th original signal line, as illustrated in FIG. 4, the 0th original signal is supplied to the 1st signal line S1 in the state in which the first switch SW1 is turned on. Therefore, the 1st signal line S1 and the 0th original signal line are considered to be electrically connected.

Figure 5:
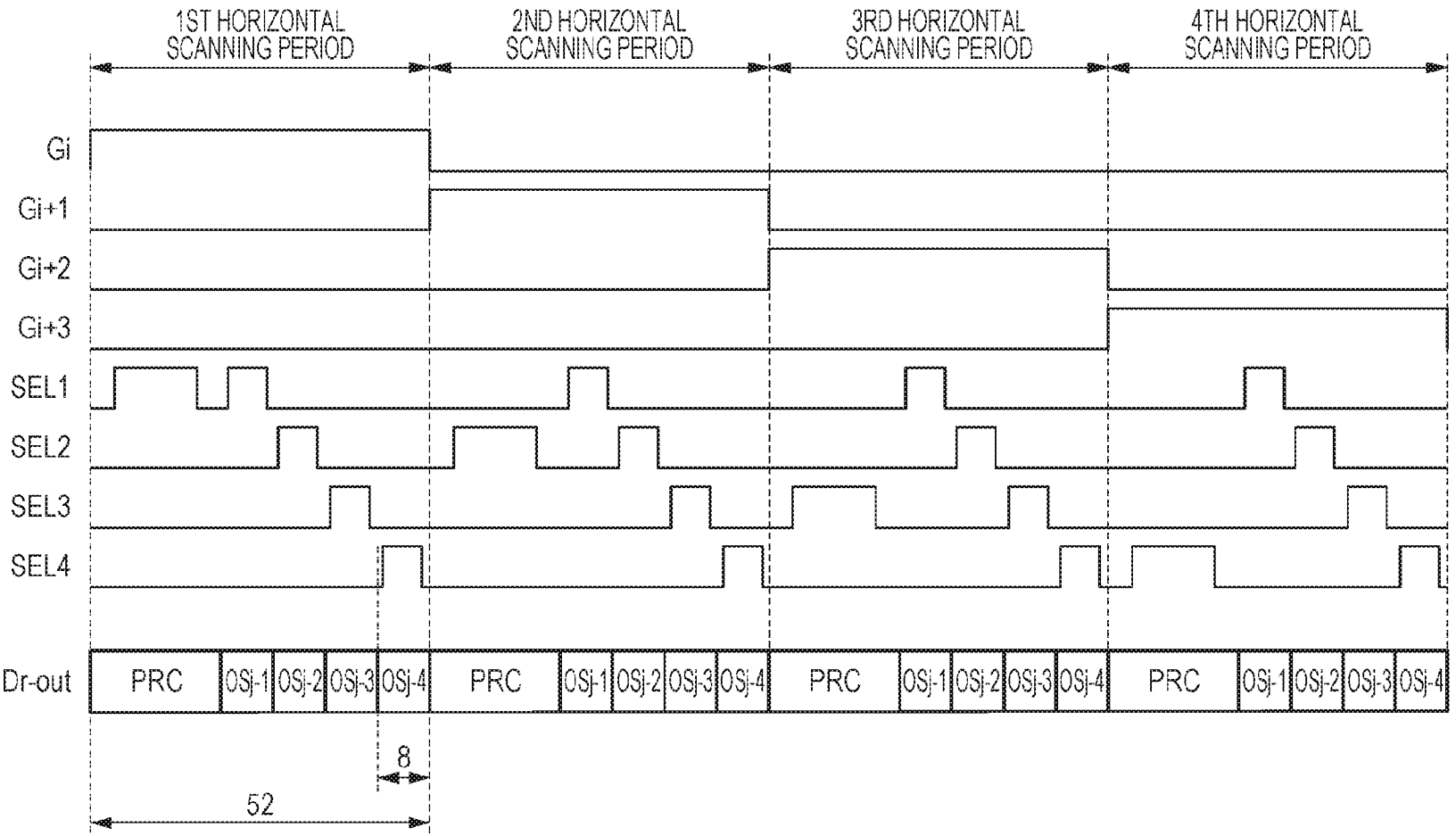
FIG. 5 is a diagram illustrating an example of a timing chart for describing a driving method according to the first embodiment.
Figure 6:
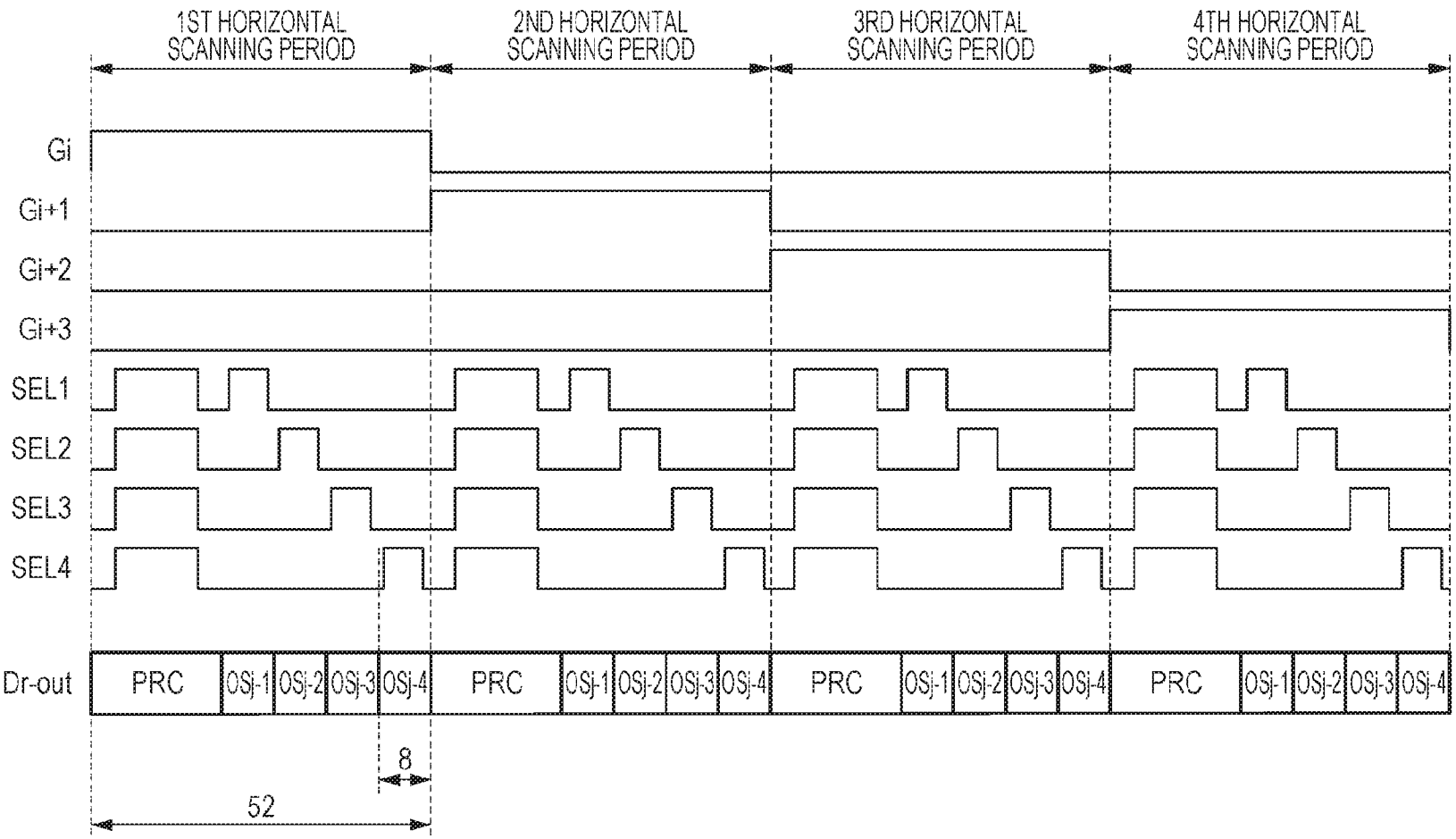
FIG. 6 is a diagram illustrating an example of a timing chart for describing a driving method according to a comparison example.

(Driving Method) FIG. 5 is a diagram illustrating an example of a timing chart for describing a driving method according to the first embodiment. FIG. 6 is a diagram illustrating an example of a timing chart for describing a driving method according to a comparison example. Next, a method of driving the electro-optic device 20 having the above-described configuration will be described with reference to FIGS. 5 and 6. FIG. 6 is a diagram for describing the comparison example, and the same reference numerals and notation are used for the same kinds of signals as those of the embodiment to facilitate the description.

A vertical scanning period of one time includes m horizontal scanning periods, but one vertical scanning period includes at least a 1st horizontal scanning period. As illustrated in FIG. 5, during the 1st horizontal scanning period, some of the k signal line groups are supplied with the precharge signal PRC, and subsequently each of the k signal line groups is supplied with the image signal (in the embodiment, for example, k=4). In other words, when the driving unit 50 supplies the k signal line groups with the image signal, the driving unit 50 supplies some of the k signal line groups with the precharge signal PRC and subsequently the image signal, and does not supply the remainder of the k signal line groups with the precharge signal PRC and supplies the remainder of the k signal line groups with the image signal during the first horizontal scanning period. On the other hand, as illustrated in FIG. 6, in the comparison example corresponding to the related art, all of the signal lines 23 are supplied with the precharge signal PRC during all of the horizontal scanning periods. By using the driving method according to the embodiment, as illustrated in FIG. 5, crosstalk is suppressed, as will be described below. Further, since the number of precharge operations is reduced, power consumption is also reduced. Accordingly, since an amount of generated heat is also small, operational stability of the electro-optic device 20 is also improved. That is, it is possible to realize the electro-optic device 20 that stably displays a high-definition image in which crosstalk is suppressed with low power consumption.

In short, when the precharge signal PRC is supplied, at least one of the 1st sequence signal SEL1 to the k-th sequence signal SELk is set to be a non-selection signal during the 1st horizontal scanning period. For example, when a horizontal scanning period in which an i-th row scanning line Gi is selected is set to be the 1st horizontal scanning period and the precharge signal PRC is supplied during this horizontal scanning period, the precharge signal PRC is supplied to only one signal line group (in this example, the 1st sequence signal line group) among the k signal line groups and the precharge signal PRC is not supplied to the 3 remaining signal line groups during this horizontal scanning period. In practice, when the precharge signal PRC is supplied, only the 1st sequence signal SEL1 enters a selection state and the j-th original signal OSj is supplied as the precharge signal PRC to only the (jk+1)-th signal line Sjk+1 during a horizontal scanning period in which the i-th row scanning line Gi is selected. The other sequence signals enter a non-selection state. Thereafter, the 1st sequence signal SEL1 to the k-th sequence signal SELk sequentially enter the selection state chronologically, the j-th original signal OSj is supplied as the 1st sequence image signal OSj-1 to the (jk+1)-th signal line Sjk+1, and subsequently the j-th original signal OSj is supplied as the 2nd sequence image signal OSj-2 to the (jk+2)-th signal line Sjk+2. Thereafter, likewise, the j-th original signal OSj is supplied as the k-th sequence image signal OSj-k to the (jk+k)-th signal line Sjk+k. In the embodiment, one horizontal scanning period is expressed as a time of 52 units. A period (precharge period) in which the precharge signal PRC is supplied from the display signal supply circuit 32 is a 20-unit time. A period in which the 1st sequence image signal OSj-1 is supplied from the display signal supply circuit 32 is an 8-unit period. A period in which the 2nd sequence image signal OSj-2 is supplied from the display signal supply circuit 32 is an 8-unit period. A period in which the 3rd sequence image signal OSj-3 is supplied from the display signal supply circuit 32 is an 8-unit period. A period in which the 4th sequence image signal OSj-4 is supplied from the display signal supply circuit 32 is an 8-unit period. Further, when it is not necessary to distinguish the period in which the 1st sequence image signal OSj-1 is supplied, the period in which the 2nd sequence image signal OSj-2 is supplied, the period in which the 3rd sequence image signal OSj-3 is supplied, and the period in which the 4th sequence image signal OSj-4 is supplied from each other, these periods are collectively referred to as image periods.

It is preferable that one vertical scanning period further include a 2nd horizontal scanning period. The 2nd horizontal scanning period continues from the 1st horizontal scanning period. During the 2nd horizontal scanning period, the precharge signal PRC is supplied to some of the k signal line groups, and subsequently, the image signal is supplied to each of the k signal line groups. At this time, the signal lines supplied with the precharge signal PRC are set to differ between the 1st and 2nd horizontal scanning periods. In other words, during the 2nd horizontal scanning period, the driving unit 50 supplies some of the k signal line groups with the precharge signal PRC and subsequently the image signal, and does not supply the remainder of the k signal line groups with the precharge signal PRC and supplies the remainder of the k signal line groups with the image signal. At this time, the signal lines supplied with the precharge signal PRC are set to differ between the 1st and 2nd horizontal scanning periods. Since the signal lines supplied with the precharge signal PRC differ between the 1st and 2nd horizontal scanning periods, the number of precharge operations is reduced, and the signal lines supplied with the precharge signal PRC during the 1st horizontal scanning period and the signal lines supplied with the precharge signal PRC during the 2nd horizontal scanning period can be changed.

In short, when the precharge signal PRC is supplied, at least one of the 1st sequence signal SEL1 to the k-th sequence signal SELk is set to be the non-selection signal even during the 2nd horizontal scanning period. At this time, the sequence signal set to be non-selection signal during the 1st horizontal scanning period is set to be different from the sequence signal set to be non-selection signal during the 2nd horizontal scanning period. In the case of the present example, a horizontal scanning period in which an i+1-th scanning line Gi+1 is selected is set to be the 2nd horizontal scanning period. However, during this horizontal scanning period, only one signal line group (in this example, the 2nd sequence signal line group) of the k signal line groups is supplied with the precharge signal PRC and the 3 remaining signal line groups are not supplied with the precharge signal PRC, when the precharge signal PRC is supplied. That is, during a horizontal scanning period in which the i+1-th row scanning line Gi+1 is selected, only the 2nd sequence signal SEL2 enters the selection state and the j-th original signal OSj is supplied as the precharge signal PRC to only the (jk+2)-th signal line Sjk+2, when the precharge signal PRC is supplied. The other sequence signals enter the non-selection state. The signals considered to be the non-selection signals during the 1st horizontal scanning period are the 2nd sequence signal SEL2, the 3rd sequence signal SEL3, and the 4th sequence signal SEL4. The signals considered to be non-selection signals during the 2nd horizontal scanning period are the 1st sequence signal SEL1, the 3rd sequence signal SEL3, and the 4th sequence signal SEL4. Likewise, at least one sequence signal is set to differ between the sequence signals considered to be the non-selection signals during the 1st horizontal scanning period and the sequence signals considered to be non-selection signals during the 2nd horizontal scanning period. As a result, at least one signal line group is set to differ between the signal line groups not supplied with the precharge signal PRC during the 1st horizontal scanning period and the signal line groups not supplied with the precharge signal PRC during the 2nd horizontal scanning period. Thereafter, the 1st sequence signal SEL1 to the k-th sequence signal SELk sequentially enter the selection state chronologically, the j-th original signal OSj is supplied as the 1st sequence image signal OSj-1 to the (jk+1)-th signal line Sjk+1, and subsequently the j-th original signal OSj is supplied as the 2nd sequence image signal OSj-2 to the (jk+2)-th signal line Sjk+2. Thereafter, likewise, the j-th original signal OSj is supplied as the k-th sequence image signal OSj-k to the (jk+k)-th signal line Sjk+k.

It is the most preferable that one vertical scanning period include at least k horizontal scanning periods from the 1st horizontal scanning period to the k-th horizontal scanning period, some of the k signal line groups be supplied with the precharge signal PRC, and subsequently each of the k signal line groups be supplied with the image signal during each of the k horizontal scanning periods, and all of the k signal line groups be supplied with the precharge signal PRC the same number of times during the periods of the 1st horizontal scanning period to the k-th horizontal scanning period. In other words, it is preferable that one vertical scanning period include at least the 1st to k-th horizontal scanning periods, the driving unit 50 supply some of the k signal line groups with the precharge signal PRC, subsequently supply some of the k signal line groups with the image signal, not supply the remainder of the k signal line groups with the precharge signal PRC, and supply the remainder of the k signal line groups with the image signal during each of the 1st to k-th horizontal scanning periods, and the driving unit 50 supply all of the k signal line groups with the precharge signal PRC during the 1st to k-th horizontal scanning periods. This is because the number of precharge operations can be reduced and all of the signal lines can be supplied with the precharge signal PRC.

In the embodiment, since k=4, as illustrated in FIG. 5, the vertical scanning period of one time includes four horizontal scanning periods of the 1st horizontal scanning period to the 4th horizontal scanning period. The 1st horizontal scanning period is a scanning period in which the i-th row scanning line Gi is selected, the 2nd horizontal scanning period is a scanning period in which the i+1-th row scanning line Gi+1 is selected, the 3rd horizontal scanning period is a scanning period in which the i+2-th row scanning line Gi+2 is selected, and the 4th horizontal scanning period is a scanning period in which the i+3-th row scanning line Gi+3 is selected. During each of the four horizontal scanning periods, some of the four signal line groups (in the embodiment, one signal line group) are supplied with the precharge signal PRC, and subsequently each of the four signal line groups is supplied with the image signal. Since the signal line group supplied with the precharge signal PRC is changed during each horizontal scanning period, all of the four signal line groups are supplied with the precharge signal PRC the same number of times during the periods of the 1st horizontal scanning period to the 4th horizontal scanning period. In the embodiment, all of the four signal line groups are supplied with the precharge signal PRC at a ratio of one time per four horizontal scanning periods. Thereafter, a cycle from the 1st horizontal scanning period to the 4th horizontal scanning period is repeated for all of the horizontal scanning periods. In the present specification, an operation of supplying the signal lines 23 with the precharge signal PRC is referred to as a precharge operation.

As illustrated in FIG. 5, the signal line group in which the precharge operation is performed differs for each horizontal scanning period and the signal line groups are desirably configured to be cycled once during a horizontal scanning period of I times (where I is a value greater than 0) the number of signal line groups k. In short, it is preferable that the precharge operation be performed in each signal line group for every horizontal scanning periods of kI times. In the embodiment, the precharge operation is performed on all of the signal lines 23 during every four horizontal scanning periods of 1 time (where I=1) of the number (where k=4) of signal line groups. As will be described in detail below, this is because crosstalk is suppressed even when the precharge operation is not performed once during one horizontal scanning period. A driving load (capacitance to be set to be a signal potential of the selection state) on the control device 30 at the time of the precharge operation is reduced by 1/the number (the number of sequence signals) of the signal line groups (1/k), compared to the configuration of the related art, and thus the power consumption is also reduced.

(Crosstalk) In the related art, as illustrated in FIG. 6, all of the signal lines 23 are supplied with the precharge signal PRC at a ratio of one time per horizontal scanning period. This is because crosstalk appearing in the vertical direction is accordingly suppressed. The inventors of the present disclosure have carried out a close study and have confirmed that the effect of suppressing crosstalk can be obtained even when the precharge operation is not performed once during one horizontal scanning period. Next, this will be described.

FIGS. 7A and 7B are diagrams for describing a relation between a frequency of the precharge operation and crosstalk. A quantitative method for crosstalk will be described in FIG. 7A and an example of an evaluation result is shown in FIG. 7B. In the quantitative method for crosstalk, as illustrated in FIG. 7A, the peripheries of a black window are set to 10% grayscale as background grayscale luminance when the black window with a 50% width is displayed in the middle of the display region 42. A ratio of a difference between background grayscale luminance B and crosstalk portion luminance C to the background grayscale luminance B is set as a crosstalk amount ((B−C)/B×100). In the experiment, the crosstalk amount was measured while changing the frequency of the precharge operation. The measurement result is shown in FIG. 7B.

As illustrated in FIG. 7B, a crosstalk amount of about 25% was measured when no precharge operation is performed (in FIG. 7B, written as "NO PRC"). On the other hand, when the precharge operation is performed from at a ratio of one time during one horizontal scanning period (in FIG. 7B, written as "ONCE FOR 1 H" and corresponding to a technology of the related art) to at a ratio of one time during 32 horizontal scanning periods (in FIG. 7B, written as "ONCE FOR 32 H"), all of the crosstalk amounts were about 2%, and thus the crosstalk amounts were suppressed almost equally. When the frequency of the precharge operation is reduced to less than once during 32 horizontal scanning periods, a tendency to gradually increase the crosstalk amount was shown. For example, when the precharge operation is performed once during 64 horizontal scanning period (in FIG. 7B, written as "ONCE FOR 64 H"), the crosstalk amount is increased to about 6%. When the crosstalk amount exceeds substantially 3%, many people recognize the crosstalk. Therefore, when the crosstalk amount is considered to be less than 3%, an image is considered to have high quality.

Accordingly, to display a high-quality image, the driving unit 50 supplies each of the k signal line groups with the precharge signal PRC a plurality of times during one vertical scanning period. A period in which a given precharge signal PRC is supplied and subsequently a next precharge signal PRC is supplied is assumed to be equal to or less than 32 horizontal scanning periods. This is because the crosstalk is suppressed, as illustrated in FIG. 7B.

As described above, the precharge operation is considered to be cycled once during the horizontal scanning periods of I times the number of signal line groups k. That is, the precharge operation is performed on each signal line 23 once during every kI horizontal scanning periods. At this time, as illustrated in FIG. 7B, the value of kI is set to be greater than 1 and less than 32. That is, the precharge operation is not performed during all of the horizontal scanning periods (where $1<kI$), but is performed at least once during 32 horizontal scanning periods (where kI equal to or less than 32). To realize this, it is desirable that one vertical scanning period include a horizontal scanning period in which all of the k signal line groups are not supplied with the precharge signal PRC and are supplied with only the image signal. For example, when the precharge operation is performed once during 16 horizontal scanning periods (where kI=16, and k=4 and I=4 in the present example), as illustrated in FIG. 5, four horizontal scanning periods of the 16 horizontal scanning periods are set to be a 1st horizontal scanning period (in which the precharge signal PRC is supplied to only the 1st sequence signal line group), a 2nd horizontal scanning period (the precharge signal PRC is supplied to only the 2nd sequence signal line group), a 3rd horizontal scanning period (the precharge signal PRC is supplied to only the 3rd sequence signal line group), and a 4th horizontal scanning period (the precharge signal PRC is supplied to only the 4th sequence signal line group). Further, during the 12 remaining horizontal scanning periods, all of the signal lines 23 are not supplied with the precharge signal PRC and are supplied with only the image signal. Since the vertical scanning period includes the horizontal scanning periods in which the precharge signal PRC is not supplied, the number of precharge operations is reduced.

The value of I may be less than 1. For example, when "I=0.5" is set, each signal line 23 is supplied with the precharge signal PRC at a ratio of one time per every 2 horizontal scanning periods in the case of the present example (where k=4). In this case, the 1st sequence signal line group and the 3rd sequence signal line group are supplied with the precharge signal PRC during the 1st horizontal scanning period and the 3rd horizontal scanning period. The 2nd sequence signal line group and the 4th sequence signal line group are supplied with the precharge signal PRC during the 2nd horizontal scanning period and the 4th horizontal scanning period. In this way, each signal line 23 is supplied with the precharge signal PRC at a ratio of one time per 2 horizontal scanning periods.

For example, when "I=1/3" is set, each signal line 23 is supplied with the precharge signal PRC at a ratio of one time per 4/3 horizontal scanning periods in the case of the present example (where k=4). That is, each signal line 23 is supplied with the precharge signal PRC at a ratio of three times per 4 horizontal scanning periods. In this case, the 1st sequence signal line group, the 2nd sequence signal line group, and the 3rd sequence signal line group are supplied with the precharge signal PRC during the 1st horizontal scanning period. The 2nd sequence signal line group, the 3rd sequence signal line group, and the 4th sequence signal line group are supplied with the precharge signal PRC during the 2nd horizontal scanning period. The 3rd sequence signal line group, the 4th sequence signal line group, and the 1st sequence signal line group are supplied with the precharge signal PRC during the 3rd horizontal scanning period. The 4th sequence signal line group, the 1st sequence signal line group, and the 2nd sequence signal line group are supplied with the precharge signal PRC during the 4th horizontal scanning period. In this way, each signal line 23 is supplied with the precharge signal PRC at a ratio of three times per 4 horizontal scanning periods.

(Other Electronic Apparatuses) The electro-optic device 20 is driven by the above-described driving method. Examples of an electronic apparatus in which the electro-optic device 20 is embedded include a rear projection type television, a direct-view type television, a mobile phone, a portable audio apparatus, a personal computer, a video camera monitor, a car navigation apparatus, a pager, an electronic organizer, a calculator, a word processor, a workstation, a video phone, a POS terminal, and a digital still camera in addition to the projector described with reference to FIG. 1.

Figure 8:
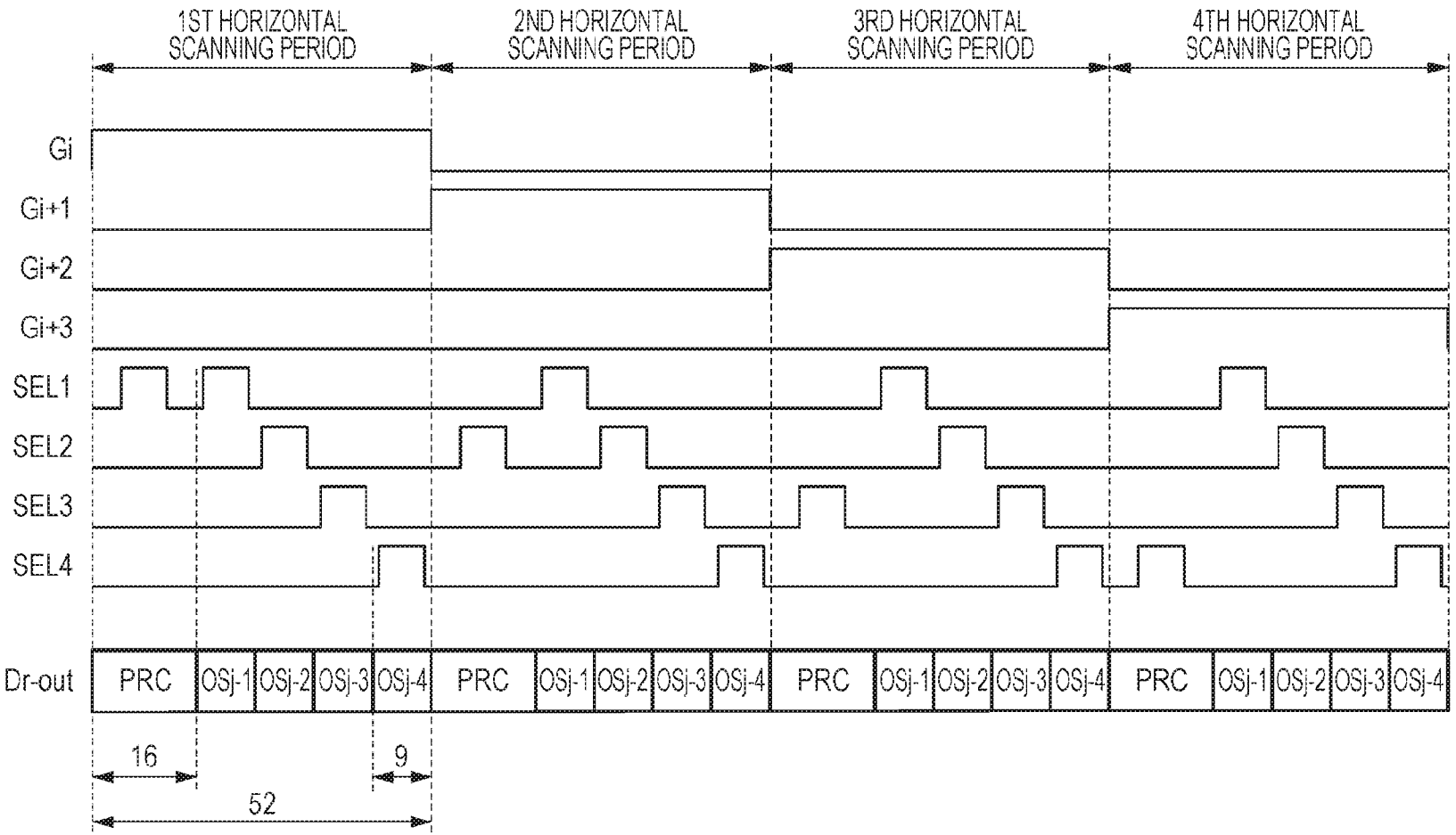
FIG. 8 is a diagram illustrating an example of a timing chart for describing a driving method according to a second embodiment.

Second Embodiment (Form 1 in Which Precharge Period is Shortened) FIG. 8 is a diagram illustrating an example of a timing chart for describing a driving method according to a second embodiment. Next, a method of driving the electro-optic device 20 according to the second embodiment will be described with reference to FIG. 8. The same reference numerals are given to the same portions as those of the first embodiment and the repeated description will be omitted.

The method of driving the electro-optic device 20 according to the embodiment illustrated in FIG. 8 is different from the method of driving the electro-optic device 20 according to the first embodiment illustrated in FIG. 5 in that a precharge period is considered to be shortened and an image period is considered to be lengthened. The remaining configuration is substantially the same as that of the first embodiment. In the method of driving the electro-optic device 20 according to the first embodiment (see FIG. 5), the precharge period has been set to be the 20-unit time and each image period has been set to be the 8-unit period. On the other hand, in the method of driving the electro-optic device 20 according to the embodiment, as illustrated in FIG. 8, the precharge period is considered to be shortened to a 16-unit time and each image period is considered to be lengthened to a 9-unit time.

The driving unit 50 controls a supply period (precharge period) of the precharge signal PRC and a supply period (image period) of the image signal. When the supply period of the precharge signal PRC is shortened, it is desirable to lengthen the supply period of the image signal. As described in detail in the first embodiment, the driving load (capacitance to be set to be a signal potential of the selection state) on the control device 30 at the time of the precharge operation is reduced by 1 (1/k)/the number (the number of sequence signals) of the signal line groups, compared to the configuration of the related art. Therefore, a time constant (a product of wiring resistance and capacitance) to a wiring for which the precharge operation is performed is reduced to 1/k. Accordingly, theoretically, the precharge period can be set to 1/k of the precharge period of the related art. In the embodiment, since k=4, the precharge period can be shortened to a 5-unit time (20-unit time/4). However, as illustrated in FIG. 8, the precharge period is set to be a 16-unit time. Accordingly, each image period is considered to be lengthened to a 9-unit time. Since the supply period of the image signal is lengthened, an exact image signal can be supplied to each pixel.

Figure 9:
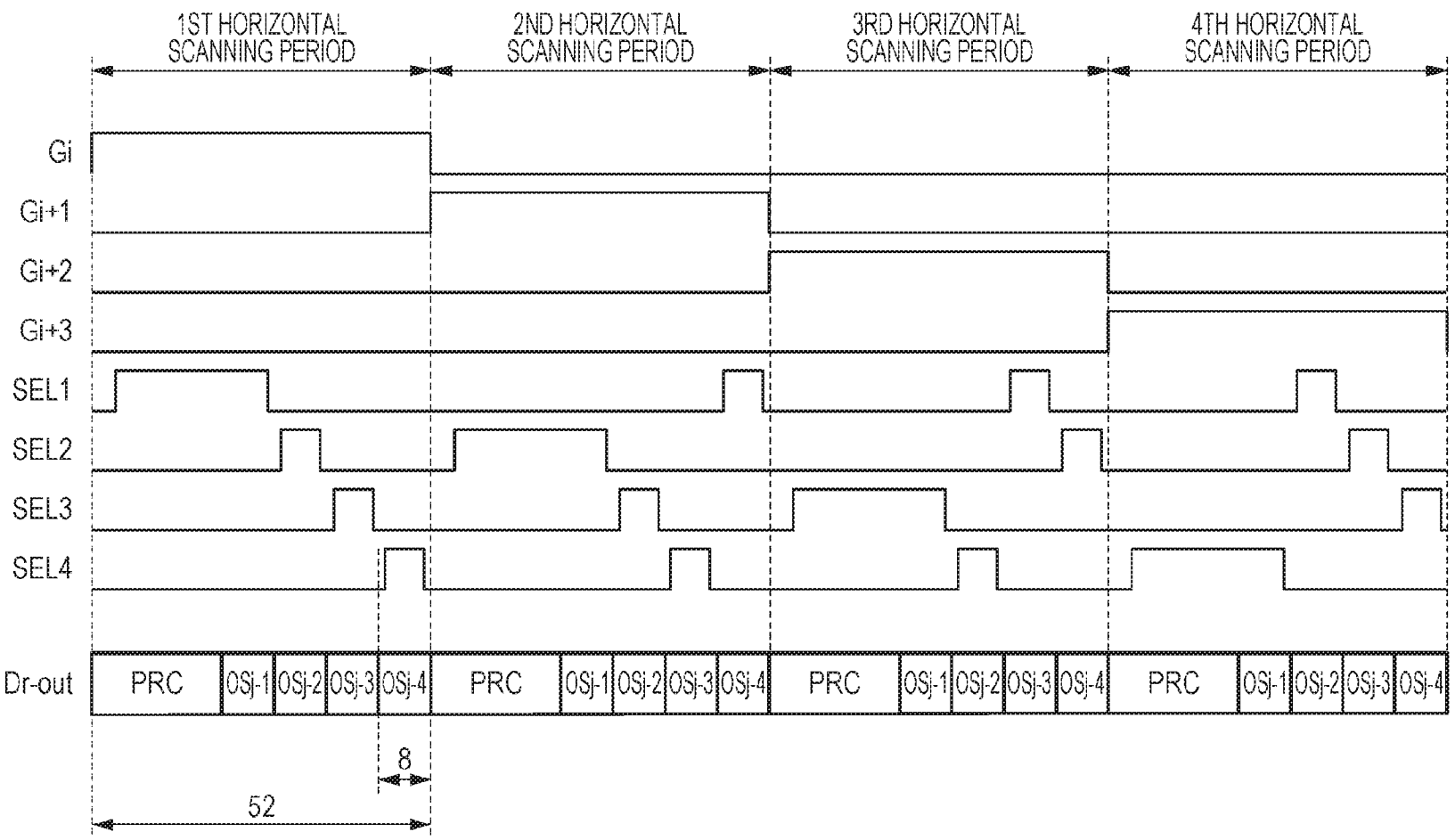
FIG. 9 is a diagram illustrating an example of a timing chart for describing a driving method according to a third embodiment.

Third Embodiment (Form in Which Sequence Signals are Combined) FIG. 9 is a diagram illustrating an example of a timing chart for describing a driving method according to a third embodiment. Next, a method of driving the electro-optic device 20 according to the third embodiment will be described with reference to FIG. 9. The same reference numerals are given to the same portions as those of the first and second embodiments and the repeated description will be omitted.

The method of driving the electro-optic device 20 according to the embodiment illustrated in FIG. 9 is different from the method of driving the electro-optic device 20 according to the first embodiment illustrated in FIG. 5 in that the sequence signals are combined. The remaining configuration is substantially the same as that of the first embodiment.

In the method of driving the electro-optic device 20 according to the first embodiment (see FIG. 5), a period considered to be a non-selection state is provided between a sequence signal for supplying the precharge signal PRC to the signal line groups and a sequence signal for supplying the image signal to the signal line groups. For example, in the first embodiment (see FIG. 5), during the 1st horizontal scanning period, the 1st sequence signal SEL1 is considered to enter the selection state to supply the precharge signal PRC to the 1st sequence signal line group, is subsequently considered to enter the non-selection state once, and is subsequently considered to enter the selection state again to supply the 1st sequence image signal OSj-1 to the 1st sequence signal line group. On the other hand, in the driving method according to the embodiment, the driving unit 50 supplies the precharge signal PRC and continuously supplies the image signal of each sequence. That is, as illustrated in FIG. 9, for example, during the 1st horizontal scanning period, the 1st sequence signal SEL1 is considered to enter the selection state to supply the precharge signal PRC to the 1st sequence signal line group and is subsequently considered not to enter the non-selection state and to be continuously in the selection state and the 1st sequence image signal OSj-1 is supplied to the 1st sequence signal line group continuously after the precharge signal PRC. In this way, the selection signal for the precharge signal PRC and the selection signal for the image signal are continuously supplied in regard to the sequence signals. Therefore, the number of switching operations of the sequence signals is reduced. That is, the number of times the sequence lines are charged and discharged is reduced, and thus power consumption of the switching can be further reduced.

Figure 10:
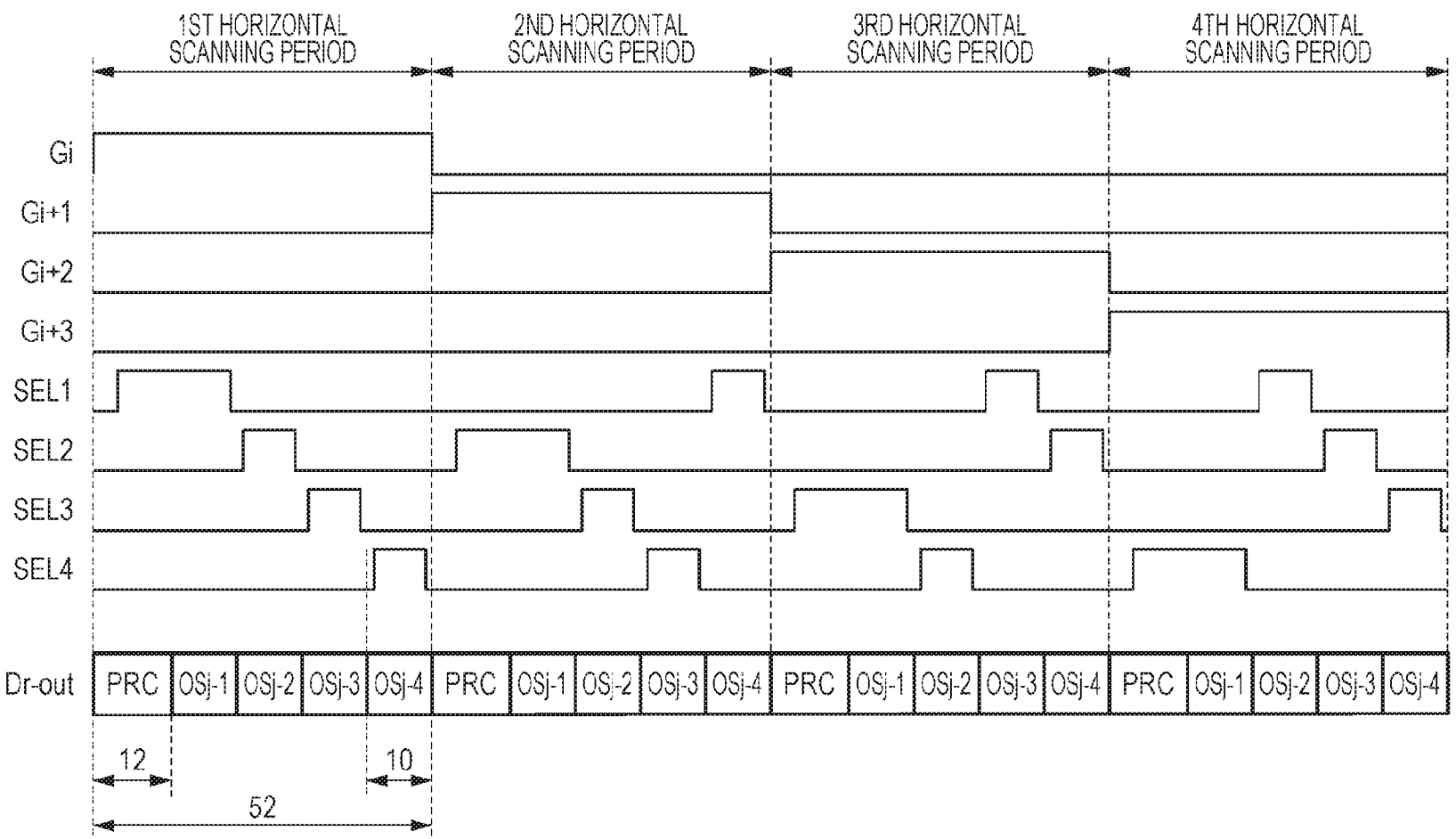
FIG. 10 is a diagram illustrating an example of a timing chart for describing a driving method according to a fourth embodiment.

Fourth Embodiment (Form 2 in Which Precharge Period is Shortened) FIG. 10 is a diagram illustrating an example of a timing chart for describing a driving method according to a fourth embodiment. Next, a method of driving the electro-optic device 20 according to the fourth embodiment will be described with reference to FIG. 10. The same reference numerals are given to the same portions as those of the third embodiment and the repeated description will be omitted.

The method of driving the electro-optic device 20 according to the embodiment illustrated in FIG. 10 is different from the method of driving the electro-optic device 20 according to the third embodiment illustrated in FIG. 9 in that a precharge period is considered to be shortened and an image period is considered to be lengthened. The remaining configuration is substantially the same as that of the third embodiment. In the method of driving the electro-optic device 20 according to the third embodiment (see FIG. 9), the precharge period has been set to be the 20-unit time and each image period has been set to be the 8-unit period. On the other hand, in the method of driving the electro-optic device 20 according to the embodiment, as illustrated in FIG. 10, the precharge period is shortened to a 12-unit time and each image period is lengthened to a 10-unit time.

The driving unit 50 controls a supply period (precharge period) of the precharge signal PRC and a supply period (image period) of the image signal. When the supply period of the precharge signal PRC is shortened, it is desirable to lengthen the supply period of the image signal. As described in detail in the first embodiment, the driving load (capacitance to be set to be a signal potential of the selection state) on the control device 30 at the time of the precharge operation is reduced by 1 (1/k)/the number (the number of sequence signals) of the signal line groups, compared to the configuration of the related art. Therefore, a time constant (a product of wiring resistance and capacitance) to a wiring for which the precharge operation is performed is reduced to 1/k. Accordingly, theoretically, the precharge period can be set to 1/k of the precharge period of the related art. In the embodiment, since k=4, the precharge period can be shortened to a 5-unit time (20-unit time/4). However, as illustrated in FIG. 10, the precharge period is set to be a 12-unit time. Accordingly, each image period is considered to be lengthened to a 10-unit time. Since the supply period of the image signal is lengthened, an exact image signal can be supplied to each pixel.

Figure 11:
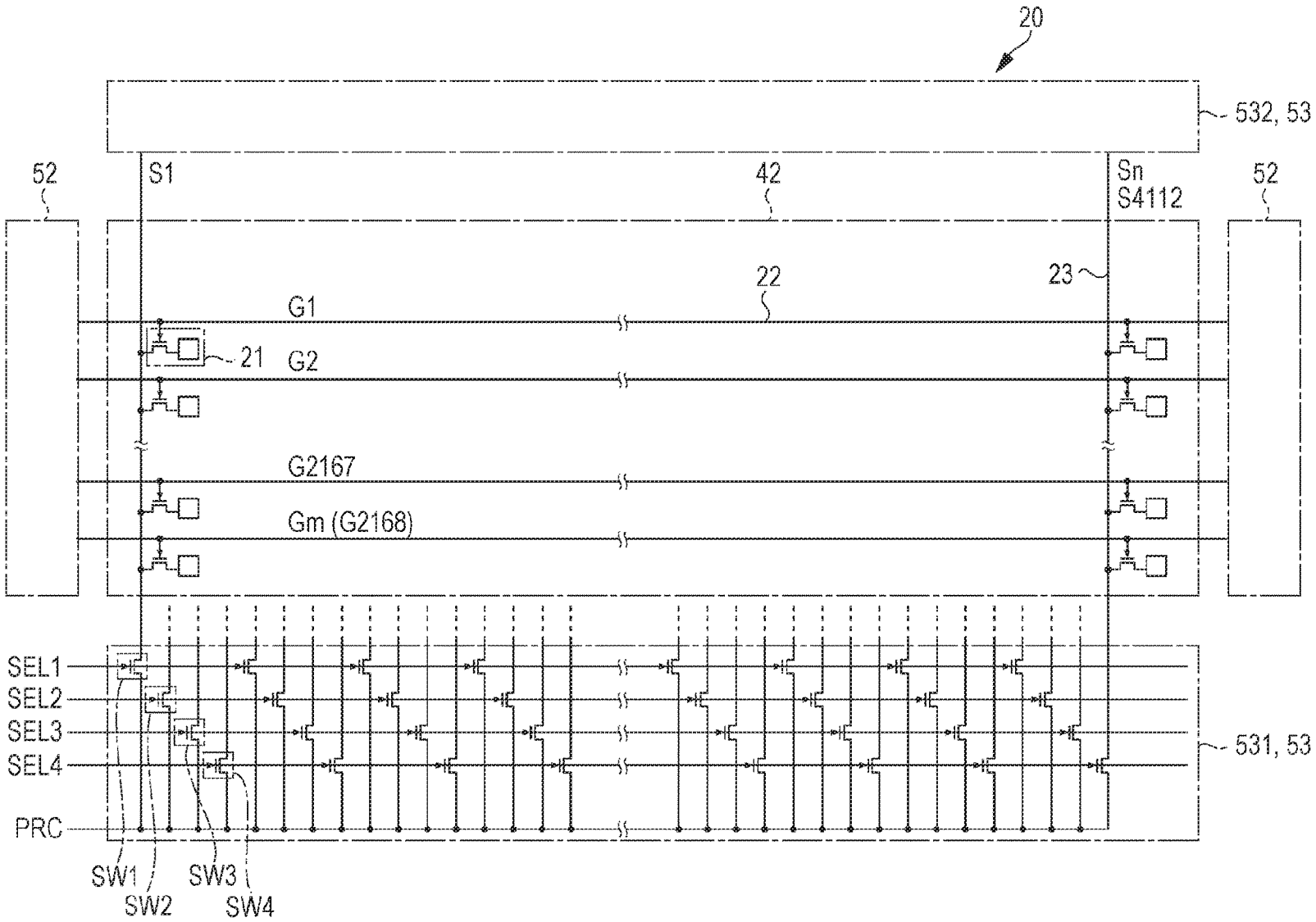
FIG. 11 is a diagram illustrating the circuit configuration of a signal line driving circuit according to a fifth embodiment.

Fifth Embodiment (Form in Which Signal line Driving Circuit is Different) FIG. 11 is a diagram for describing the circuit configuration of a signal line driving circuit according to a fifth embodiment. Next, the configuration of a signal line driving circuit 53 according to the fifth embodiment will be described with reference to FIG. 11. The same reference numerals are given to the same portions as those of the first embodiment and the repeated description will be omitted.

The signal line driving circuit 53 according to the embodiment illustrated in FIG. 11 is different from the signal line driving circuit 53 according to the first embodiment illustrated in FIG. 4 in that the signal line driving circuit 53 is divided into a precharge circuit 531 and an image signal circuit 532. The remaining configuration is substantially the same as that of the first embodiment. The signal line driving circuit 53 (see FIG. 4) according to the first embodiment has supplied the signal lines 23 with all of the precharge signal PRC and the image signal of each sequence. On the other hand, the signal line driving circuit 53 according to the embodiment separately includes the precharge circuit 531 and the image signal circuit 532. The precharge circuit 531 supplies the signal lines 23 with the precharge signal PRC and the image signal circuit 532 supplies the signal lines 23 with the image signal of each sequence.

In the precharge circuit 531, k sequence lines corresponding to k kinds of sequence signals and one line for the precharge signal PRC are wired. A p-th sequence signal SELp is supplied to a p-th sequence line (where p is any integer from 1 to k). For example, the 1st sequence signal SEL1 is supplied to the 1st sequence line and the 2nd sequence signal SEL2 is supplied to the 2nd sequence line. In this way, likewise, a k-th sequence signal SELk is supplied to a k-th sequence line. The precharge signal PRC is supplied to the line for the precharge signal PRC.

The precharge circuit 531 includes first n/k switches SW1 to k-th n/k switches SWk. The first n/k switches SW1 to the k-th n/k switches SWk are formed as thin film transistors as in the pixel transistors 24. One end (one of the source and the drain) of a p-th switch SWp is electrically connected to the (jk+p)-th signal line Sjk+p, the other end (the other of the source and the drain) of the p-th switch SWp is electrically connected to the line for the precharge signal PRC, and the gate of the p-th switch SWp is electrically connected to a p-th sequence line. Accordingly, when the p-th sequence signal SELp becomes a selection signal, the p-th switch SWp is turned on and the precharge signal PRC is supplied to the (jk+p)-th signal line Sjk+p (p-th sequence signal line group). For example, the 1st switch SW1 is disposed between the line for the precharge signal PRC and the 1st signal line S1 belonging to the 1st sequence signal line group, and the gate of the 1st switch SW1 is electrically connected to the 1st sequence line. Therefore, when the 1st sequence signal SEL1 becomes a selection signal, the 1st switch SW1 is turned on and the precharge signal PRC is supplied to the 1st signal line S1. Likewise, for example, the 4th switch SW4 is disposed between the line for the precharge signal PRC and the 4112th signal line S4112 belonging to the 4th sequence signal line group, and the gate of the 4th switch SW4 is electrically connected to the 4th sequence line. Therefore, when the 4th sequence signal SEL4 becomes a selection signal, the 4th switch SW4 is turned on and the precharge signal PRC is supplied to the 4112th signal line S4112.

The image signal circuit 532 includes a shift register circuit (not shown) or an analog signal sampling switch (not shown) and supplies the image signal to the signal lines 23 in a line sequence or a dot sequence.

The remaining configuration is the same as that of the first embodiment. A vertical scanning period of one time includes m horizontal scanning periods, but one vertical scanning period includes at least a 1st horizontal scanning period. As illustrated in FIG. 5, during the 1st horizontal scanning period, some of the k signal line groups are supplied with the precharge signal PRC by the precharge circuit 531, and subsequently each of the k signal line groups is supplied with the image signal by the image signal circuit 532 (in the embodiment, for example, k=4). In other words, when the driving unit 50 supplies the k signal line groups with the image signal, the driving unit 50 supplies some of the k signal line groups with the precharge signal PRC and subsequently the image signal, and does not supply the remainder of the k signal line groups with the precharge signal PRC and supplies the remainder of the k signal line groups with the image signal during the first horizontal scanning period. The image signal may be supplied to each signal line group, as illustrated in FIG. 5, the image signal may be supplied sequentially to the signal lines 23 one by one (dot-sequence driving), or the image signal may be supplied concurrently to all of the signal lines 23 (line-sequence driving).

The invention is not limited to the above-described embodiments, but the above-described embodiment may be modified or improved in various forms. Modification examples will be described below.

(First Modification Example) (Form in Which Order of Sequence Signals is Different) In the first to fourth embodiments, the sequence signal lines supplied with the precharge signal PRC during the 1st horizontal scanning period to the 4th horizontal scanning period are the 1st sequence signal line group, the 2nd sequence signal line group, the 3rd sequence signal line group, and then the 4th sequence signal line group, but any order may be used. For example, a driving method may be realized in such a manner that the 1st sequence signal line group is supplied with the precharge signal PRC and the 2nd, 3rd, and 4th sequence signal line groups are not supplied with the precharge signal PRC during the 1st horizontal scanning period; the 3rd sequence signal line group is supplied with the precharge signal PRC and the 1st, 2nd, and 4th sequence signal line groups are not supplied with the precharge signal PRC during the 2nd horizontal scanning period; the 2nd sequence signal line group is supplied with the precharge signal PRC and the 1st, 3rd, and 4th sequence signal line groups are not supplied with the precharge signal PRC during the 3rd horizontal scanning period, and the 4th sequence signal line group is supplied with the precharge signal PRC and the 1st, 2nd, and 3rd sequence signal line groups are not supplied with the precharge signal PRC during the 4th horizontal scanning period. In this way, the signal line groups are supplied with the precharge signal PRC in any order.

(Second Modification Example) (Form in Which Precharge Operation is Performed on Plurality of Sequences) In the first to fourth embodiments, the sequence signal lines supplied with the precharge signal PRC during the 1st horizontal scanning period to the 4th horizontal scanning period are the 1st sequence signal line group, the 2nd sequence signal line group, the 3rd sequence signal line group, and then the 4th sequence signal line group, but the precharge signal PRC may be supplied for a plurality of sequences through an operation performed once. For example, a driving method may be realized in such a manner that the 1st and 2nd sequence signal line groups are supplied with precharge signal PRC and the 3rd and 4th sequence signal line groups are not supplied with the precharge signal PRC during the 1st horizontal scanning period; the 2nd and 3rd sequence signal line groups are supplied with the precharge signal PRC and the 4th and 1st sequence signal line groups are not supplied with the precharge signal PRC during the 2nd horizontal scanning period; the 3rd and 4th sequence signal line groups are supplied with the precharge signal PRC and the 1st and 2nd sequence signal line groups are not supplied with the precharge signal PRC during the 3rd horizontal scanning period; and the 4th and 1st sequence signal line groups are supplied with the precharge signal PRC and the 2nd and 3rd sequence signal line groups are not supplied with the precharge signal PRC during the 4th horizontal scanning period. In this way, any combination of sequences and any order in which the precharge signal PRC is supplied in the precharge operation performed once can be used. However, in any combination, all of the sequence signal line groups are not supplied with the precharge signal in the precharge operation performed once.

REFERENCE SIGNS LIST

Gi i-th scanning line
OSj j-th original signal
OSj-1 1st sequence image signal
OSj-2 2nd sequence image signal
OSj-3 3rd sequence image signal
OSj-4 4th sequence image signal
PRC Precharge signal
SEL1 1st sequence signal
SEL2 2nd sequence signal
SEL3 3rd sequence signal
SEL4 4th sequence signal
Sjk+p (jk+p)-th signal line
SW1 1st switch
SW2 2nd switch
SW3 3rd switch
SW4 4th switch
20 Electro-optic device
21 Pixel
22 Scanning line
23 Signal line
24 Pixel transistor
25 Pixel electrode
26 Liquid crystal
27 Common electrode
30 Control device
32 Display signal supply circuit
33 Storage circuit
42 Display region
50 Driving unit
51 Driving circuit
52 Scanning line driving circuit
53 Signal line driving circuit
201 First panel
202 Second panel
203 Third panel
531 Precharge circuit
532 Image signal circuit
1000 Transmissive display device
1100 Illumination optical system
1300 Projection optical system
1400 Projection surface

The invention claimed is:

1. An electro-optic device comprising:
a plurality of scanning lines;
a plurality of signal lines; and
pixels disposed to correspond to intersections of the plurality of scanning lines and the plurality of signal lines,
wherein the plurality of signal lines is classified into k signal line groups, k being an integer equal to or greater than 2,
wherein a vertical scanning period includes at least a first horizontal scanning period in which the k signal line groups are supplied an image signal, and
wherein during the first horizontal scanning period, some of the k signal line groups have entered a selection state and are supplied a precharge signal, and subsequently the some of the k signal line groups are maintained in the selection state without entering a non-selection state and being supplied the image signal, and
the remainder of the k signal line groups have entered the selection state and are supplied the image signal without being supplied the precharge signal.

2. The electro-optic device according to claim 1, wherein:
during a second horizontal scanning period continuing from the first horizontal scanning period:
some of the k signal line groups have entered the selection state and are supplied a precharge signal, and subsequently the some of the k signal line groups are maintained in the selection state without entering the non-selection state and being supplied the image signal, and
the remainder of the k signal line groups have entered the selection state and are supplied the image signal without being supplied the precharge signal, and
the signal lines supplied with the precharge signal differ between the first and second horizontal scanning periods.

3. The electro-optic device according to claim 1, wherein:
a vertical scanning period includes at least first to k-th horizontal scanning periods,
during each of the first to k-th horizontal scanning periods:
some of the k signal line groups have entered the selection state and are supplied the precharge signal, and subsequently the some of the k signal line groups are maintained in the selection state without entering the the non-selection state and are supplied the image signal, and,
the remainder of the k signal line groups have entered the selection state and are supplied the precharge signal, and during the vertical scanning period, all of the k signal line groups are supplied the precharge signal.

4. The electro-optic device according to claim 3, wherein the vertical scanning period includes a horizontal scanning period in which all of the k signal line groups are not supplied with the precharge signal and are supplied with the image signal.

5. The electro-optic device according to claim 3, wherein:
each of the k signal line groups is supplied the precharge signal a plurality of times during the vertical scanning period, and
a period between a given signal line group is supplied with the precharge signal and the given signal line group is subsequently supplied with a subsequent precharge signal is equal to or less than 32 horizontal scanning periods.

6. The electro-optic device according to claim 1, further comprising:
a plurality of switches that is electrically connected to the plurality of signal lines, and
a driving unit that supplies the precharge signal, the image signal and a sequence signal, the sequence signal entering the plurality of signal lines to the selection state.

7. The electro-optic device according to claim 6, wherein:
the driving unit controls a supply period of the precharge signal and a supply period of the image signal, and
when the supply period of the precharge signal is shortened, the supply period of the image signal is lengthened.

8. An electronic apparatus comprising:
the electro-optic device according to claim 1.

9. A method of driving an electro-optic device that includes a plurality of scanning lines, a plurality of signal lines, and pixels disposed to correspond to intersections of the plurality of scanning lines and the plurality of signal lines, wherein:

the plurality of signal lines is classified into k signal line groups, k being an integer equal to or greater than 2, a vertical scanning period includes at least a first horizontal scanning period in which the k signal line groups are supplied an image signal, and during the first horizontal scanning period:

some of the k signal line groups have entered a selection state and are supplied a precharge signal, and subsequently the some of the k signal line groups being maintained the selection state without entering a non-selection state and being supplied the image signal, and the remainder of the k signal line groups having entered the selection state and being supplied the image signal without being supplied the precharge signal.

10. The method of driving an electro-optic device according to claim 9, wherein:

the vertical scanning period further includes a second horizontal scanning period in which the k signal line groups are supplied the image signal, during the second horizontal scanning period:

some of the k signal line groups have entered the selection state and are supplied the precharge signal, and subsequently the some of the k signal line groups are maintained in the selection state without entering the non-selection state and being supplied the image signal, and the remainder of the k signal line groups have entered the selection state and are supplied the image signal without being supplied the precharge signal, and the signal lines supplied with the precharge signal differ between the first and second horizontal scanning periods.

11. An electro-optic device driven by the method of driving the electro-optic device according to claim 9.

12. An electronic apparatus comprising:

the electro-optic device according to claim 11.

* * * * *